US009399565B2

(12) United States Patent
Kisselbach

(10) Patent No.: US 9,399,565 B2
(45) Date of Patent: Jul. 26, 2016

(54) METHOD FOR THE SPEED SYNCHRONIZATION OF A CRANE DRIVE AND CRANE DRIVE

(71) Applicant: Liebherr-Werk Ehingen GmbH, Ehingen/Donau (DE)

(72) Inventor: Alexander Kisselbach, Ehingen/Donau (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 215 days.

(21) Appl. No.: 14/137,140

(22) Filed: Dec. 20, 2013

(65) Prior Publication Data

US 2014/0283507 A1 Sep. 25, 2014

(30) Foreign Application Priority Data

Dec. 21, 2012 (DE) ..... 10 2012 025 253

(51) Int. Cl.
*F15B 21/08* (2006.01)
*B66C 13/20* (2006.01)

(52) U.S. Cl.
CPC ..... *B66C 13/20* (2013.01); *F15B 21/082* (2013.01)

(58) Field of Classification Search
CPC ..... F15B 21/082; E02F 9/2296; F04B 17/05; F04B 49/20; B66C 13/20
USPC ..... 60/431
See application file for complete search history.

(56) References Cited

U.S. PATENT DOCUMENTS 4,716,727 A 1/1988 Kotter
4,836,165 A * 6/1989 Kubota ..... E02F 9/2246 123/357
5,197,860 A * 3/1993 Nishida ..... F04B 49/065 60/434
5,477,679 A 12/1995 Tatsumi et al.
6,176,126 B1 * 1/2001 Tsuruga ..... E02F 9/2239 60/431
6,308,516 B1 * 10/2001 Kamada ..... E02F 9/2228 60/450
8,454,319 B2 * 6/2013 Kitani ..... B66C 13/20 417/10
2012/0285152 A1 11/2012 Sugano et al.

FOREIGN PATENT DOCUMENTS

DE 34 43 354 A1 5/1986
DE 41 02 621 A1 8/1992
DE 43 16 361 A1 11/1994
DE 690 31 226 T2 9/2009
DE 10 2012 207 880 A1 11/2012
EP 2 080 728 A1 7/2009
WO WO 2012/048588 A1 4/2012

OTHER PUBLICATIONS

German Search Report with partial translation dated Sep. 2, 2013 (Thirteen (13) pages).

* cited by examiner

*Primary Examiner* — Thomas E Lazo
(74) *Attorney, Agent, or Firm* — Crowell & Moring LLP

(57) ABSTRACT

A method is used for synchronizing the speed of a hydraulic crane drive having at least one hydraulic consumer, which is fed with a variable volumetric rate of flow by way of at least one hydraulic variable displacement pump. The at least one hydraulic variable displacement pump is driven by way of a drive unit of the crane. By way of the crane control system, a swashplate angle of the at least one variable displacement pump is open and/or closed loop controlled as a function of the demanded volumetric flow rate for at least one consumer and/or on the basis of one additional parameter.

16 Claims, 8 Drawing Sheets

METHOD FOR THE SPEED SYNCHRONIZATION OF A CRANE DRIVE AND CRANE DRIVE

BACKGROUND OF THE INVENTION

The present invention relates to a method for synchronizing the speed of a hydraulic crane drive comprising at least one hydraulic consumer, for example a hydraulic motor, that is fed by means of at least one hydraulic variable displacement pump, and in which the at least one variable displacement pump is driven by means of the drive unit of the crane.

A crane, and in particular a mobile crane, has a hydraulic power system for driving the various crane functions. This hydraulic power system is supplied by one or more hydraulic pumps, which are supplied at least in part by means of a central drive unit of the crane, such as an internal combustion engine. The delivery volume of the individual hydraulic pumps depends on the drive speed of the motor output. The greater the delivered pump volume is, the faster is the motion speed of the individual hydraulic consumers, which are fed by means of the pump, in order to carry out the various functions of the crane.

Typically the operator of the crane does not know the requisite motor speed that is necessary to correctly operate the hydraulic power system of the crane at the desired motion speed.

Owing to this lack of information, the operator allows the drive unit to run at high speed in order to guarantee sufficient reserves to set any motion speed. However, in many cases a significantly lower speed is also adequate. This situation leads not only to an excessive fuel consumption and high noise emission, but also to an unnecessarily high accelerated wear of the drive unit.

SUMMARY OF THE INVENTION

One object of the present invention is to optimize the fuel consumption of the crane and simultaneously to reduce the noise emission.

This object is achieved by way of a method as claimed. Advantageous embodiments of the method are also claimed.

The method claimed is for synchronizing the speed of a hydraulic crane drive having at least one hydraulic consumer, such as a hydraulic motor, for carrying out a specific crane function. This at least one consumer serves, for example, as a rotary drive of the superstructure, or is used to drive a winch. Furthermore, at least one hydraulic variable displacement pump is provided to feed the at least one hydraulic consumer with an adjustable volumetric rate of flow. At least one such variable displacement pump is driven by at least one central drive unit of the crane.

To implement a method for synchronizing the speed, the invention provides that the speed of the drive unit and the swashplate angle of the at least one variable displacement pump are open and/or closed loop controlled, as a function of the demanded volumetric flow rate for at least one of the consumers and/or as a function of one additional crane-specific parameter, by means of the crane control system.

The drive unit can be an internal combustion engine, in particular a diesel motor-driven generator, or an electric motor or a hybrid motor. The method is carried out independently of the desired system structure of the hydraulic power system. The consumer(s) and the at least one pump can be interconnected as an open loop or closed loop hydraulic circuit.

The desired motion speed of the crane actuator, or rather the hydraulic consumer, is established by means of the user input. The crane control system determines, by means of this user input, the energy required for this purpose, i.e. the required volumetric rate of flow that has to be made available to the hydraulic consumer(s) by the at least one variable displacement pump. The crane control system is responsible for setting the desired motion speed. To this end the crane control system controls and/or regulates, as required, the drive unit of the crane as well as at least one hydraulic variable displacement pump.

In addition, an additional crane-specific parameter for open and/or closed loop control of the drive unit may or may not also be considered. Possible parameters are, for example, one value or more values that characterize the height level above normal zero of the crane and/or a charging operation of an energy accumulator and/or the efficiency of all or at least some of the consumers and/or at least one environmental condition, in particular the ambient temperature of the crane and/or a direct input, in particular, a set speed input of the crane operator. Environmental conditions, for example, the external pressure as well as the ambient temperature, might possibly influence the working conditions of the hydraulic power system. The charging of an energy accumulator may perhaps require a higher speed of the drive unit. At least one of these values or at least some of these values can be considered by the crane control system for the open and/or closed loop control of the speed and/or the swashplate angle of at least one variable displacement pump. This consideration occurs either in addition or as an alternative to the demanded volumetric rate of flow for at least one consumer.

The concept "control of the speed" is understood to mean not only an increase, but also a decrease in the current speed. The same applies to the open and/or closed loop control of the swashplate angle. This swashplate angle can be decreased or increased selectively as a function of the demanded volumetric flow rate and/or an additional parameter.

At least one proportionally controllable directional seated valve can be provided. This directional seated valve is connected between at least one variable displacement pump and at least one consumer. In this case it may be expedient that, in addition, an open and/or closed loop control of at least one directional seated valve takes place as a function of the demanded volumetric flow rate and/or an additional parameter. For example, a signal for actuating at least one valve is generated as a function of the user input. A volumetric rate of flow occurs as a function of the input signal, and the valve can allow this volumetric rate of flow to pass to the hydraulic consumer. The crane control system can compute this volumetric rate of flow.

The directional seated valve is adjusted, for example, by means of a suitable adjusting mechanism, such as an electromagnet.

It has proven to be advantageous if, first and foremost, an open loop control of the swashplate angle takes place and only, as required, is an open loop control of the speed of the drive unit performed. If the drive motor is running in idle mode, then the displacement volume of at least one hydraulic pump is changed with the swashplate angle as a function of the demanded volumetric rate of flow and/or as a function of an additional parameter. To the extent that the demanded volumetric rate of flow exceeds the volumetric rate of flow that can be made available by means of the current swashplate angle, then the result is a synchronization of the motor speed. By increasing the motor speed, the delivered volume can be increased up to the demanded volumetric rate of flow.

It is expedient if the demanded volumetric rate of flow is set by means of at least one operating lever. This at least one operating lever is provided, for example, in the crane cab. The crane operator can set the desired volumetric rate of flow by actuating the lever, i.e. rotating the lever out of the neutral position as far as into the extreme end position. For example, at least one operating lever can be rotated out of a center position, i.e. the neutral position, in four directions. At the same time the lever position in connection with one or more reductions represents the desired volumetric rate of flow. Based on a number of different operations, such as approaching a shut-off limit of the working range limit, the crane control system determines so-called reductions. These reductions are typically in a range between 0 and 100%, where an amount of 100% corresponds to no reduction. The input by means of the operating lever is computed with such a reduction and determines a final reduced volumetric rate of flow.

The signals of at least one operating lever can be transmitted selectively by means of a BUS connection or, as an alternative, by means of a radio link to the crane control system.

In order to control the speed of the drive unit, the crane control system has to determine a corresponding set speed as a function of the demanded volumetric rate of flow. This process of determining a corresponding set speed can be performed with the use of a performance data map. The performance data map includes the torque curves and/or the speed curves with the respective fuel consumption of the drive unit. Such a performance data map is stored ideally in the crane control system. For example, the correlation between the hydraulic pressure and the motor speed is shown for at least one family of characteristics, and/or the correlation between the torque and the speed is shown for at least one family of characteristics. The associated fuel consumption, in kilograms per hour, is shown for each value of one of the families of characteristics.

As an alternative, the set speed can be computed from the demanded volumetric rate of flow by means of the crane control system. The computation occurs dynamically at the run time, as a function of the volumetric flow rate demanded at the current time.

The influence that the crane control system exercises on the speed synchronization can be overridden at any time by a corresponding user input. This means that when the crane control system has either reduced or increased the speed of the drive unit or more specifically the swashplate angle of at least one variable displacement pump, this action can be overridden at any time by a user input. The actuation of the gas pedal constitutes a conceivable user input.

In an especially advantageous embodiment, the speed of the drive unit is increased until the volumetric flow rate, which is determined from the instantaneous speed of the drive unit or from the speed of at least one variable displacement pump, matches or converges toward the demanded volumetric rate of flow. The volumetric flow rate that is determined from the speed is computed as a function of a single specific pump parameter. In this way it is possible to deduce a theoretically possible volumetric flow rate at the output of the variable displacement pump as a function of the known speed, at which the drive unit drives the at least one variable displacement pump. However, this assumption is valid only as long as the at least one variable displacement pump, or the fed consumer works without a load.

In the event that a load engages with the consumer or the at least one variable displacement pump, the actual volumetric flow rate deviates from the volumetric flow rate that is computed from the speed. In particular, the actual volumetric flow rate falls below the calculated volumetric flow rate. In this case, it is expedient to have the volumetric flow rate, which is determined from the instantaneous motor output power, is adjusted to the demanded volumetric flow rate by controlling the speed. The volumetric flow rate, which is determined from the instantaneous motor output power, can be determined, optionally or as an alternative, from the pump pressure being applied at the output of said at least one variable displacement pump. For this purpose it is possible to use, for example, an appropriate sensing mechanism to measure the output pressure.

In an especially advantageous embodiment it is conceivable that the speed is initially increased until the volumetric flow rate, which is determined from the instantaneous speed, matches or converges toward the demanded volumetric flow rate. Then a volumetric flow rate is determined from the instantaneous motor output power or the instantaneous pump output pressure. This computed volumetric rate of flow is transmitted to a controlled system as the input value. This controlled system adjusts the computed volumetric flow rate to the demanded volumetric flow rate by controlling the speed of the drive unit. In particular, it is expedient to use a controller, for example an I controller [integral-action controller], where the demanded volumetric flow rate is used as the desired value. The volumetric flow rate, which is determined from the instantaneous motor output power and the instantaneous pump pressure, is used as the actual value.

Against this background it is advantageous if the crane control system adjusts the acceleration and/or deceleration ramps of the drive unit speed individually and in a way that is load-dependent. For example, the speed, with which the output signal of the controller that is used follows the input signal, can be controlled by way of the reset time of the controller that is used. This time can be set dynamically.

In addition, any changes in the demanded volumetric rate of flow can be delayed and/or accelerated by means of the ramp function generator. As a result, the motor speed and, thus, also the crane itself become steady, in order to achieve a handling performance that is as uniform as possible. The rise and/or fall time, or more specifically the starting and end values, can be set dynamically.

If the hydraulic drive of the crane has a plurality of hydraulic consumers, it can be advantageous if the crane control system combines the individual volumetric flow rates, demanded by the respective consumers, into one total demand. Then the above described method is applied to the particular total demand, where in this case the total demand corresponds to the demanded volumetric flow rate. If the determined total demand exceeds the maximum possible delivery volume of the at least one variable displacement pump, then the crane control system has to divide the maximum possible delivery volume among the individual hydraulic consumers. This division is performed in proportion to the respective volumetric flow rate demanded by the individual consumers.

In an additional embodiment of the invention, the mechanical drive train can be uncoupled, in the event that the crane control system determines an idle operating mode. In particular, on determining an idling mode, the crane control system can wait a defined time interval, until it uncouples the drive train of the superstructure as close as possible at the drive unit. The defined time interval can be, for example, in a range of one minute. This arrangement reduces losses in mechanical drive shafts and in transmissions. This solution has proven to be particularly advantageous in a single motor crane, where the superstructure is driven from the crane carrier. In this case, the manual transmission is mounted very close to the motor, which is also used for the drive mode, such as for operating the crane. As a result, the whole drive train to the superstructure can be disengaged with all losses (angular gear drive), and yet, after about one to two seconds, the total power is available again to operate the crane. As an alternative or in addition to the uncoupling, an automatic shut-off of the drive unit by means of the control system can be considered.

The invention further relates to a hydraulic crane drive with a crane control system for carrying out the method according to the invention, or more specifically for carrying out an advantageous embodiment of the method according to the invention. In this case, the crane drive or rather the crane control system has suitable means for carrying out the method. These means include an appropriate computer and control logic, which can be implemented by means of hardware and/or software. As a result, the crane drive according to the invention has the same advantages and properties as the method according to the invention or more specifically as an advantageous embodiment of the method according to the invention, for which reason a repetitious description of these features shall not be presented again.

The invention additionally relates to a crane, which comprises the crane drive according to the invention. The advantages and properties of the crane correspond to those of the crane drive according to the invention.

Additional advantages and details of the invention shall be explained in detail below in connection with an exemplary embodiment that is depicted in the figures.

DETAILED DESCRIPTION OF THE INVENTION

Figure 1:
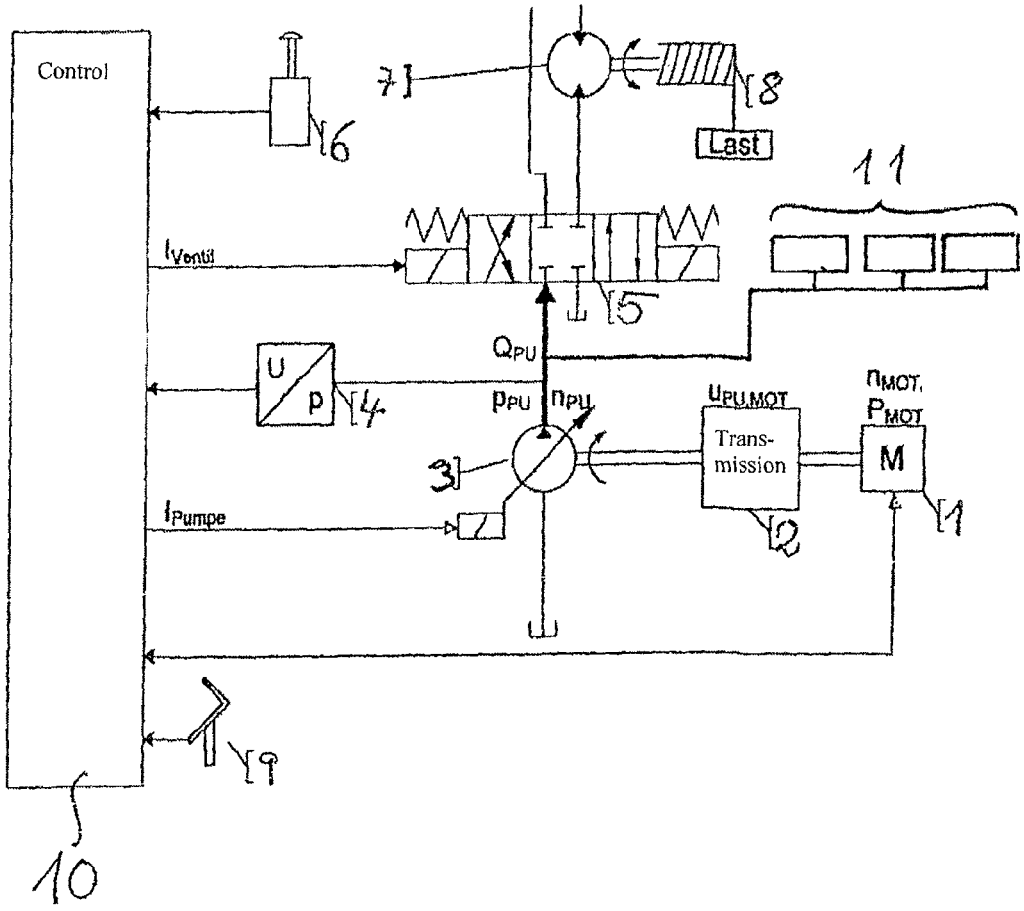
FIG. 1 is a circuit diagram of the crane drive according to the invention.

FIG. 1 shows in schematic form a circuit diagram of the crane drive according to the invention. The crane drive comprises a drive motor 1, which is designed, for example, as an internal combustion engine, in particular a diesel motor-driven generator, and the central mobile crane drive. The connection to the variable displacement pump 3 is implemented by means of the transmission 2 with constant transmission ratio. The speed of the drive motor 1 can be regulated in a range between a minimum and maximum motor speed by means of a motor control unit that is not shown here. The central crane control system 10 is connected to the motor control unit in a manner allowing communication.

The hydraulic variable displacement pump 3 delivers, as a function of the motor speed of the drive motor 1 and as a function of the pump displacement volume $V_{G,PU}$, a volumetric flow rate $Q_{PU}$ to the attached hydraulic consumer 7 as well as to the other hydraulic consumers 11. All of the consumers 7, 11 are to be optimally supplied with energy, and yet the emphasis is on a frugal consumption of fuel. The method according to the invention is described below with particular attention to the consumers 7. In principle, the rest of the consumers 11 may or shall also be considered in carrying out the method.

The displacement volume $V_{G,PU}$ of the hydraulic pump 3 can be controlled by means of the swashplate angle of the hydraulic pump 3. In this case a change in the swashplate angle is achieved by means of an adjusting mechanism. A proportionally controllable electromagnet having a control flow rate $I_{Pumpe}$ that is generated by the crane control system 10 serves as the adjusting mechanism.

The volumetric flow rate $Q_{PU}$ at the output of the variable displacement pump 3 is automatically controlled, first and foremost, by means of the swashplate angle. If the maximum displacement volume $V_{G,MAX}$ is exhausted at the maximum swashplate angle, then the volumetric flow rate $Q_{PU}$ can be further increased by increasing the motor speed.

The output line of the variable displacement pump 3 also has a pressure sensor 4, which measures the pressure $p_{PU}$ on the output side and informs the control system 10.

The variable displacement pump 3 feeds a hydraulic consumer, which is depicted in FIG. 1 as a hydraulic motor 7 for driving a hoisting wench. The hydraulic motor 7 and the variable displacement pump 3 are connected by means of a 4/3 way seated valve 5 for reversing the flow direction as well as for regulating the volumetric rate of flow. The valve is actuated by means of a proportionally controllable electromagnet. The necessary control flow rate $I_{Ventil}$ is provided by the crane control system. This crane control system determines, as a function of the demanded volumetric rate of flow, the appropriate control flow rate $I_{Ventil}$ that adjusts the possible amount of flow, which is allowed to pass at the valve, to the demanded volumetric rate of flow.

The motion speed of the hydraulic motor 7 varies as a function of the volumetric flow rate $Q_{PU}$ that is allowed to pass from the variable displacement pump over the valve 5 to the valve. A load, which is fastened to the crane winch, can generate a load torque on the winch or, more specifically, on the hydraulic motor. When the valve 5 is actuated, this load torque counteracts the driving torque of the drive motor 1 and at the same time increases the pressure $p_{PU}$ on the pump 3.

The crane operator has the option of influencing the volumetric flow rate $Q_{PU}$ by means of the operating lever 6. The degrees of freedom of the operating lever 6 are fixed by a coordinate system. In the zero or center position, no actuation of the hydraulic motor 7 occurs. The rotation of the operating lever into the x or y direction is detected by the crane control system 10 and converted in connection with the valve flow rate $I_{Ventil}$ into the demanded volumetric flow rate $Q_{Fahrer}$.

The operating lever is designed in such a way that it automatically resets itself, so that the operating lever is always moved into the neutral position, i.e. the center position, without any application of force.

The motor speed of the drive motor 1 can be changed manually in a range between the maximum speed and the minimum speed by means of a gas pedal 9.

Figure 1A:
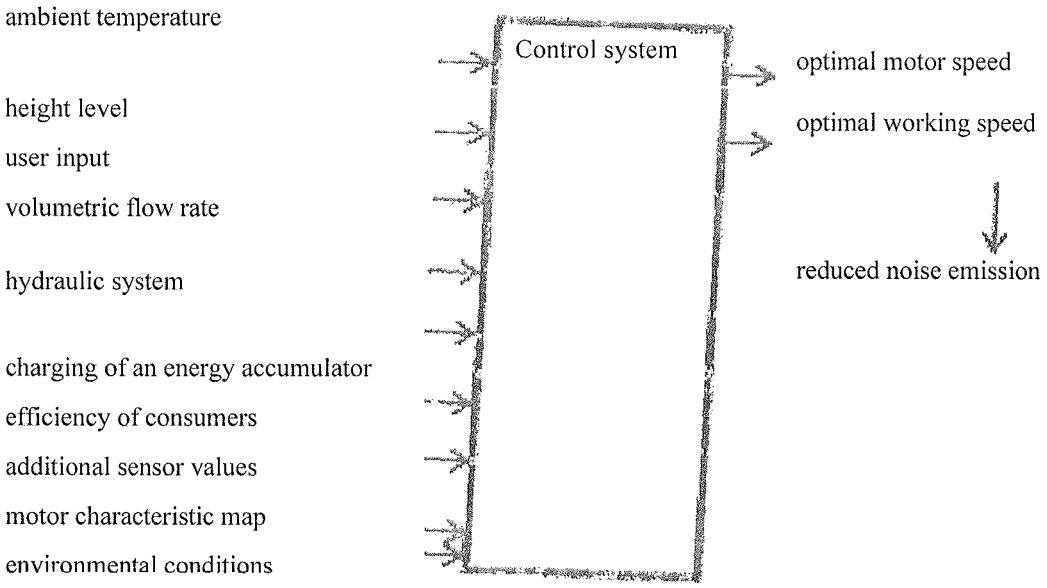
FIG. 1*a* is an overview of the input parameters used in the crane control system.

For the open and/or closed loop control of the motor speed and/or the swashplate angle of the pump 3, not only the demanded volumetric flow rate, but also additional parameters may be considered. FIG. 1*a* gives a brief overview of the parameters that might be included. For example, the ambient temperature of the crane or its height level can also be included, in order to consider those values due to environmental factors that may have an effect on the how the hydraulic system works.

Furthermore, a user input, for example, the choice of a desired set speed of the drive unit, may be considered. Similarly a charging process of an energy accumulator may have an effect on the particular speed and/or the swashplate angle, because usually the energy demand is higher for the charging process.

Additional parameters that can be mentioned include, for example, the efficiency of the consumers 7, 11 as well as any other crane-specific sensor values or more specifically the environmental conditions.

The purpose of the crane control system 10 is to determine an optimal motor speed or more specifically an optimal working speed, taking into consideration the aforementioned parameters. The result of such an optimal working speed may include not only a decrease in the fuel consumption, but also a clearly perceptible reduction in the noise emission of the crane.

Figure 2:
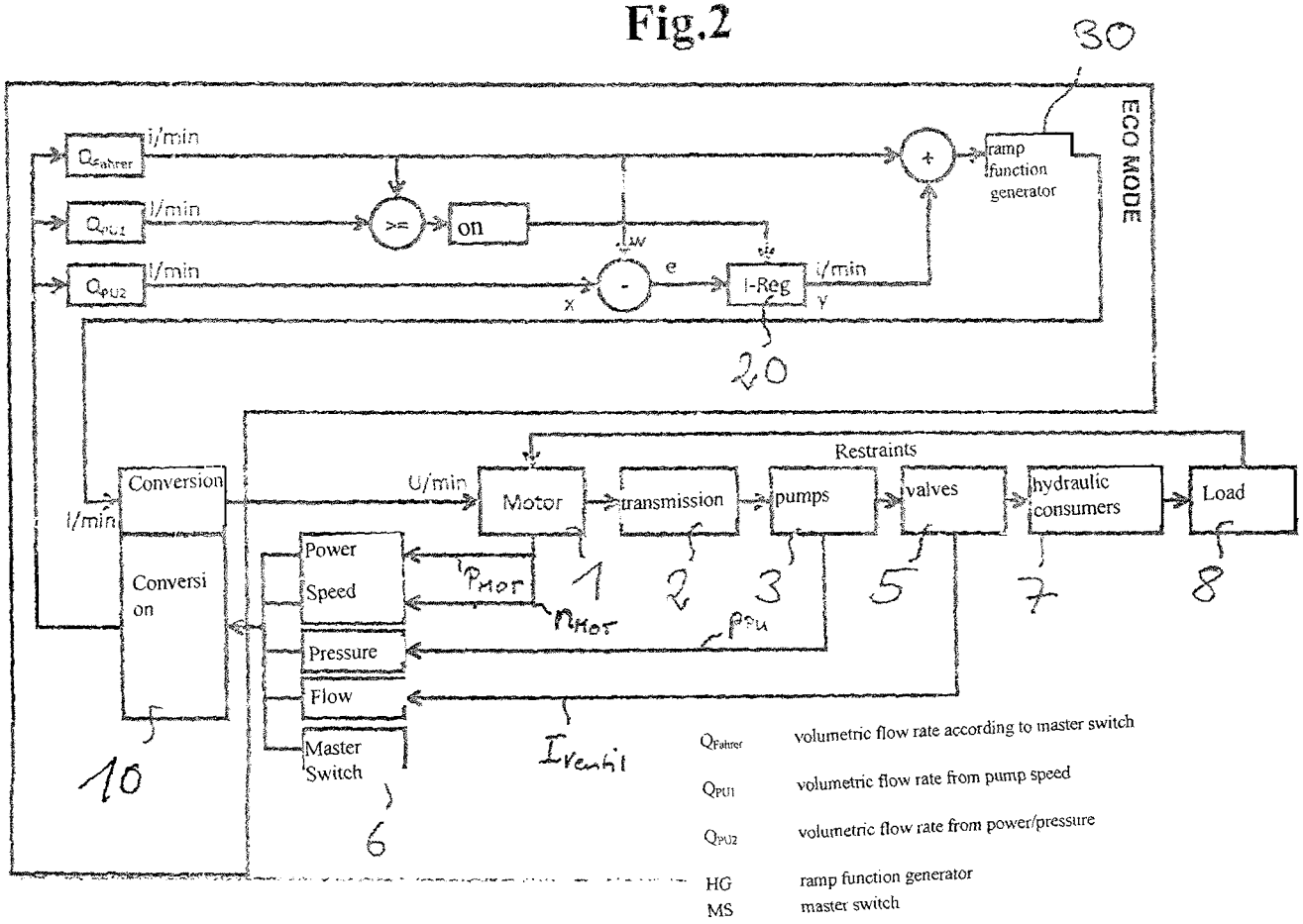
FIG. 2 is a function diagram of the inventive control algorithm for carrying out the method according to the invention.

FIG. 2 shows a function diagram of the inventive control algorithm for the speed synchronization. The blocks 1 to 8 correspond to the individual components from FIG. 1, where the same components are provided with identical reference numerals. The motor 1 delivers information data about its actual power $P_{MOT}$ or rather the actual speed $n_{MOT}$ to the crane control system 10. In addition, the output pressure $p_{PU}$ is transmitted from the variable displacement pump 3 over the sensor 4 to the crane control system.

Furthermore, the crane control system knows about the set control flow rate $I_{Ventil}$ at the directional seated valve 5. In addition, the excursion of the operating lever 6 is made accessible to the crane control system 10 by means of the bus system or radio transmission.

From the data that is made available to the crane control system, the crane control system computes continuously a plurality of volumetric flow rates. The demanded volumetric flow rate $Q_{Fahrer}$ is computed, starting from the actuation of the operating lever 6 and the demanded valve flow rate $I_{Ventil}$. The volumetric flow rate $Q_{PU1}$ is computed according to equation 1 as a function of the current motor speed $n_{MOT}$ and the maximum displacement volume of the pump 3. In this respect it pays to observe that the computation is always performed with the maximum displacement volume of the hydraulic pump, even though the actual displacement volume is set to zero when the valve is not actuated.

$$Q_{PU1}\left[\frac{1}{\min}\right] = \frac{n_{MOT}\left[\frac{U}{\min}\right]\cdot V_{G,PU}\left[\frac{1}{U}\right]\cdot u_{PU,MOT}}{1000\cdot 1000} \Rightarrow Q \sim n_{MOT}, \quad \text{where: } V_{G,PU} = V_{G,MAX} = const. \qquad \text{Equation 1}$$

$n_{MOT}$ stands for the motor speed; $V_{G,PU}$, for the displacement volume of the pump 3; and $u_{PU,MOT}$ stands for the transmission ratio of the transmission 2. Assuming that the displacement volume $V_{G,PU}$ and the transmission ratio $u_{PU,MOT}$ are constant, it follows from equation 1 that the volumetric flow rate $Q_{PU1}$ changes in proportion to the speed $n_{MOT}$. It holds:

$$Q_{PU1}=f(n_{MOT}) \qquad \text{Equation 2}$$

An additional volumetric flow rate $Q_{PU2}$ is computed on the basis of the instantaneous motor output power $P_{MOT}$ and the pump pressure $p_{PU}$ being applied.

$$Q_{PU2}\left[\frac{1}{\min}\right] = \frac{P_{MOT}[\text{kW}]\cdot 600}{P_{PU}^{[bar]}} \Rightarrow Q \sim P_{MOT}, \quad \text{where: } P_{MOT} = f(n_{MOT}) \qquad \text{Equation 3}$$

One can infer from equation 3 that the volumetric flow rate $Q_{PU2}$ varies in proportion to the power. It is assumed that the power $P_{MOT}$ increases as the speed $n_{MOT}$ increases, then the power $P_{MOT}$ in turn is proportional to the speed $n_{MOT}$. The speed $n_{MOT}$ is increased maximally up to the upper speed limit of the drive motor 1. It holds:

$$Q_{PU2}=f(P_{MOT}), \text{ where: } P_{MOT}=f(n_{MOT}) \Rightarrow Q_{PU2}=f(n_{MOT})$$

It can be seen from equations 2 and 4 that the volumetric flow rate $Q_{PU}$ is always a function of the speed $n_{MOT}$ of the drive motor 1. At this point the motor speed $n_{MOT}$ has to be changed until equations 5 and 6 are fulfilled.

$$Q_{PU1} \geq Q_{Fahrer} \qquad \text{Equation 5}$$

$$Q_{PU2} \geq Q_{Fahrer} \qquad \text{Equation 6}$$

The general formula for the motor speed based on the demanded volumetric flow rate reads:

$$n_{MOT}\left[\frac{U}{\min}\right] = \frac{Q_{PU}\left[\frac{1}{\min}\right]\cdot 1000\cdot 1000}{u_{PU,MOT}\cdot V_{G,PU}\left[\frac{1}{U}\right]} \qquad \text{Equation 7}$$

If the drive motor 1 is in the idle operating mode, then the displacement volume of the hydraulic pump 3 is changed with the swashplate angle of the hydraulic pump 3. If the operator demands a higher quantity of consumption than the pump 3 can deliver at a maximum displacement volume $V_{G,MAX}$ and in the idle operating mode, then at this point the motor speed $n_{MOT}$ has to be increased, in order to deliver the demanded quantity. It is clear from equations 2 and 4 that the volumetric flow rates $Q_{PU1}$ and $Q_{PU2}$ increase in proportion to the motor speed $n_{MOT}$. The crane control system 10 determines continuously the volumetric flow rate $Q_{Fahrer}$ requested by the operator and adjusts the motor speed $n_{MOT}$ in such a way that both volumetric flow rates $Q_{PU1}$ and $Q_{PU2}$ correspond to at least the requested volumetric flow rate $Q_{Fahrer}$.

Two cases can be distinguished with respect to an open and/or closed loop control process. Case 1 applies to a hydraulic motor 7 with no load.

Case 1:

The crane control system 10 determines the volumetric flow rate $Q_{Fahrer}$ requested by the operator. The motor speed $n_{MOT}$ is changed until $Q_{PU1}$ matches the volumetric flow rate requested by the operator $Q_{Fahrer}$. Then the crane control system 10 computes the volumetric flow rate $Q_{PU2}$, based on the instantaneous motor output power $P_{MOT}$ and the pump pressure $p_{PU}$. In the case of the hydraulic motor 7 with no load, $Q_{PU2}$ is greater than $Q_{PU1}$. This means that sufficient motor output power $P_{MOT}$ is on hand to fulfill the condition from equation 6, and that an additional increase in the motor speed $n_{MOT}$ is not necessary.

Case 2:

In the case of a hydraulic motor 7 with a load, the following applies.

The crane control system 10 determines the volumetric flow rate $Q_{Fahrer}$ requested by the operator. The motor speed $n_{MOT}$ is changed until $Q_{PU1}$ matches the volumetric flow rate requested by the operator $Q_{Fahrer}$. Then the crane control system 10 computes the volumetric flow rate $Q_{PU2}$, based on the instantaneous motor output power $P_{MOT}$ and the pump pressure $p_{PU}$. Since the loaded hydraulic motor 7 generates a counter torque to the drive torque of the drive motor 1, the result in this case is a volumetric flow rate $Q_{PU2}$ that is less than $Q_{PU1}$. The provided motor output power $P_{MOT}$ is insufficient to fulfill the condition from equation 6. Since the motor output power $P_{MOT}$ also increases as the motor speed $n_{MOT}$ increases, an additional increase in the motor speed $n_{MOT}$ is necessary.

Therefore, the method according to the invention provides the following steps:

1. The crane control system 10 determines continuously the requested volumetric flow rate $Q_{Fahrer}$. The set motor speed $n_{Soll}$ is computed with equation 7 by means of the delivered volumetric flow rate $Q_{PU}$ and is passed on to the motor control unit. If this motor speed $n_{Soll}$ is less than the minimum speed of the drive motor 1, then the drive motor 1 runs at the minimum speed. If this motor speed $n_{Soll}$ is greater than the maximum speed of the drive motor 1, then the drive motor 1 runs at the maximum speed.
2. While the internal combustion engine 1 accelerates, the control system 10 determines the current volumetric flow rate $Q_{PU1}$.
3. If the volumetric flow rate $Q_{PU1}$ reaches approximately the same value as $Q_{Fahrer}$, then the I controller 20 (FIG. 2) is activated. The I controller receives the volumetric flow rate $Q_{Fahrer}$ as the set value and the volumetric flow rate $Q_{PU2}$ as the actual value.
4. If the volumetric flow rate $Q_{PU2}$ is below $Q_{PU1}$, then the motor speed $n_{Soll}$ is increased until the volumetric flow rate $Q_{PU2}$ matches the volumetric flow rate of the operator $Q_{Fahrer}$ or until the maximum motor speed is reached. It can be assumed that the motor output power $P_{MOT}$ also increases as the motor speed $n_{MOT}$ increases.

One specific example of the actuation of the I controller 20 is shown in FIG. 2. The I controller 20 is used to balance the difference between $Q_{Fahrer}$ and $Q_{PU2}$ (x). To this end the control difference e is determined from the set value $Q_{Fahrer}$ and the actual value $Q_{PU2}$ and is transmitted to the controller 20. The I controller 20 generates the actuating signal $Q_{I\text{-}Regler}$ (Y) at the output.

Figure 3:
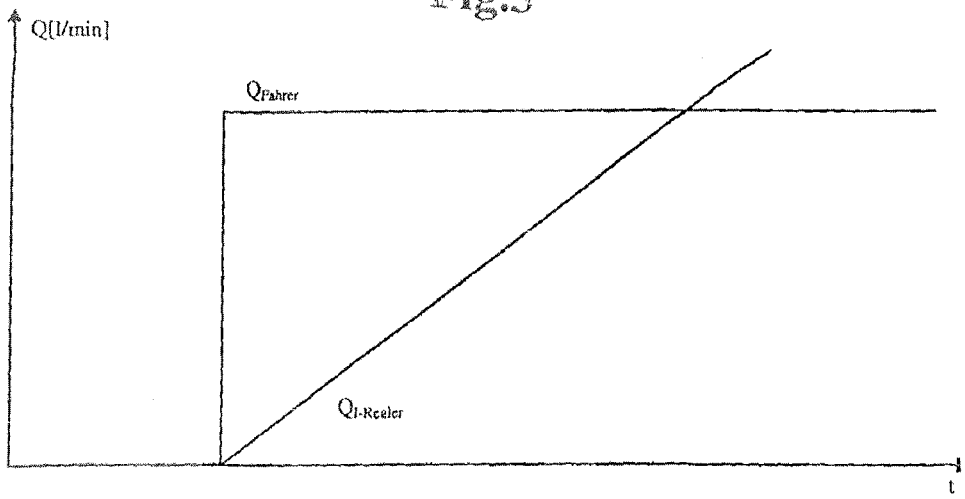
FIG. 3 is a diagram for explaining the step response of the I controller that is used.

In order to explain the step response of the I controller, reference is made to FIG. 3, which shows the curve of the signal $Q_{Fahrer}$ and the curve of the control output signal $Q_{I\text{-}Regler}$ plotted over time. The time delay results from the cycle time of the open loop control process. The speed, with which the output signal of the I controller 20 follows the input signal $Q_{Fahrer}$, is controlled by means of the reset time. This time can be set dynamically.

Figure 5:
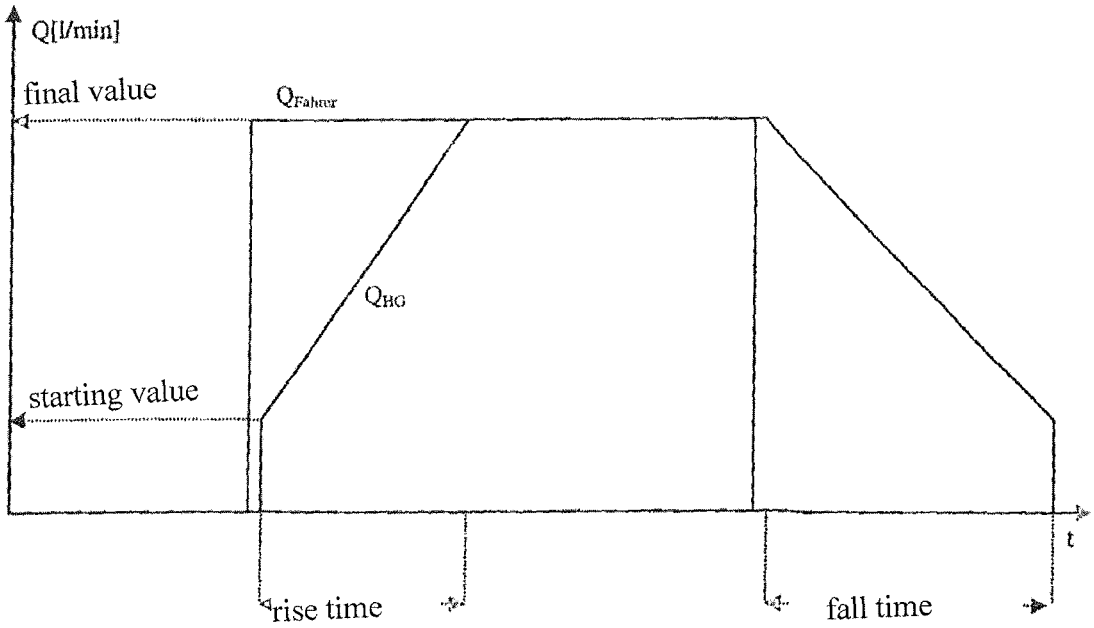
FIG. 5 is a diagram of the step response of the ramp function generator that is used.

The output signal $Q_{I\text{-}Regler}$(Y) of the I controller 20 as well as the volumetric flow rate $Q_{Fahrer}$ are added together and transmitted to the ramp function generator 30 as the input signal. As a result, a delay in the demanded volumetric pressure is achieved. FIG. 5 shows the step response of the ramp function generator 30. The implementation of the ramp function generator 30 pursues the purpose of stabilizing the motor speed $n_{MOT}$ as well as the mobile crane itself, thus enabling a handling performance that is as uniform as possible. The rise and fall time, with which the output signal of the ramp function generator 30 follows the input signal, can be controlled dynamically.

Figure 4:
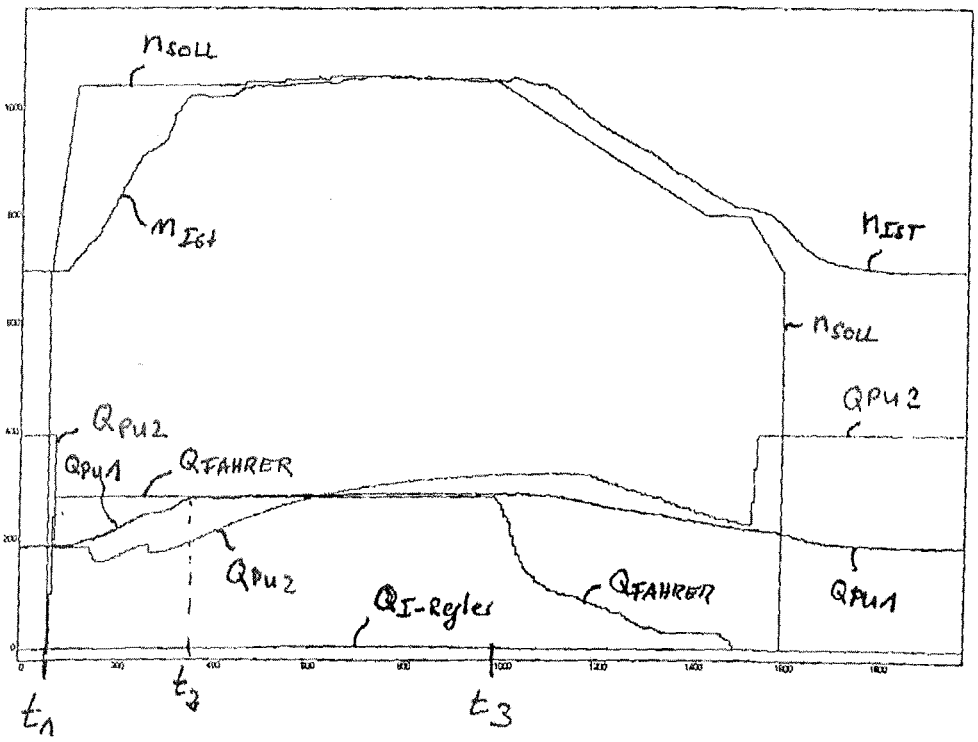
FIG. 4 is a diagram of the individual open and/or closed loop control variables over time.

FIG. 4 shows the individual open and closed loop control signals of the set and actual motor speed $n_{Soll}$, $n_{Ist}$ as well as the individual signals of the volumetric flow rates $Q_{Fahrer}$, $Q_{PU1}$, $Q_{PU2}$, $Q_{I\text{-}Regler}$ plotted over time. Up to time $t_1$ there is no input by the crane operator, so that the value for $Q_{Fahrer}$ is assumed to equal 0 ($Q_{Fahrer}$=0). In this case the set motor speed $n_{Soll}$ corresponds to the value 0; and the motor speed $n_{Ist}$ corresponds to the speed of the drive motor 1 in the idle operating mode.

The signal $Q_{PU1}$ shows the instantaneously possible delivered quantity in the idling mode and at maximum displacement volume $V_{G,MAX}$, whereas the signal $Q_{PU2}$ characterizes the possible delivered quantity based on the instantaneous motor output power $P_{MOT}$ in the idling mode and based on the measured pressure $p_{PU}$. Since the controller is not yet active at this time, the output value of the I controller 20 $Q_{I\text{-}Regler}$ has the value 0.

At the time $t_1$ the crane operator actuates the lever 6 for controlling the crane drive, so that the value for the signal $Q_{Fahrer}$ assumes a value>0. The value for the set motor speed $n_{Soll}$ follows the input of the closed loop control circuit, and the actual motor speed $n_{Ist}$ follows the respective motor speed. Since $Q_{PU1}$ depends on the actual motor speed $n_{Ist}$, this value also follows the actual motor speed $n_{Ist}$, as long as the variable displacement pump 3 is set to the maximum displacement volume $V_{G,MAX}$. The volumetric flow rate being applied at the consumer(s) 7 drives these consumers accordingly. The pressure $p_{PU}$ acting on the variable displacement pump 3 results in a decrease in the actual delivered quantity of the variable displacement pump 3, so that the value for $Q_{PU2}$ decreases sharply and falls below the value $Q_{PU1}$.

In this case the motor speed $n_{Soll}$ is increased until the value for $Q_{PU1}$ either approaches the value $Q_{Fahrer}$ or corresponds to the value (time $t_2$). Since the actual volumetric flow rate $Q_{PU2}$ is below the demanded volumetric flow rate $Q_{Fahrer}$, the I controller 20 is also included in the circuit (time $t_2$); and the set motor speed $n_{Soll}$ is increased until the value for $Q_{PU1}$ is greater than or equal to $Q_{Fahrer}$ ($Q_{PU1} \geq Q_{Fahrer}$).

At time $t_3$ the operating lever 6 is relieved of its load and moved back into the zero position. The value for $Q_{Fahrer}$ decreases in a delayed manner, so that all of the values return again to their original values.

Figure 6:
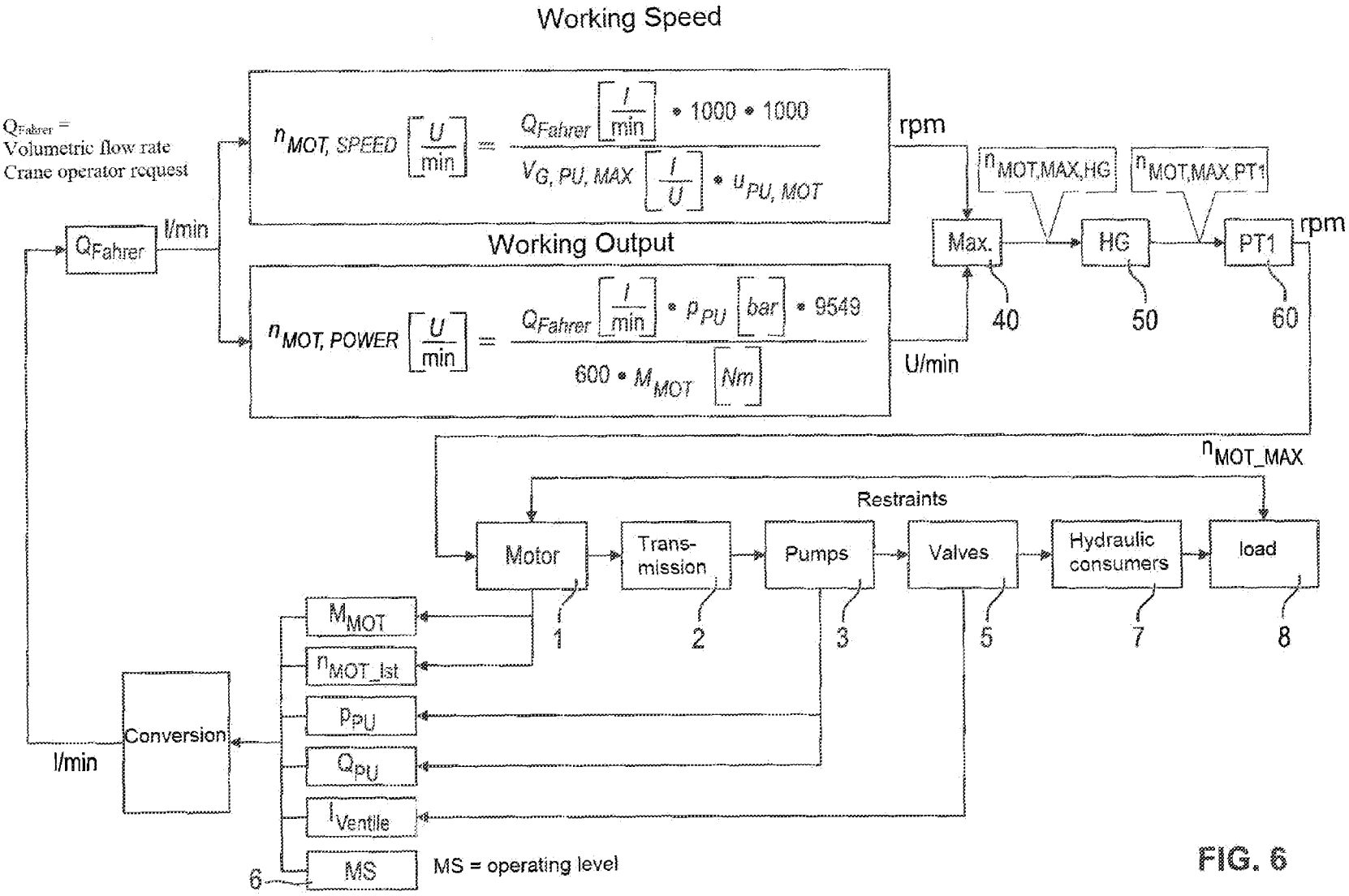
FIG. 6 is a function diagram of an alternative control algorithm for carrying out the method according to the invention.

FIG. 6 shows a function diagram of the control algorithm for synchronizing the speed according to an alternative embodiment of the invention. The blocks 1 to 8 correspond to the individual components from FIG. 1, where the same components are provided with identical reference numerals. The motor 1 delivers information data about its motor torque $M_{MOT}$ or more specifically its actual speed $n_{MOT}$ to the crane control system 10. In addition, the output pressure $p_{PU}$ as well as the volumetric flow rate $Q_{PU}$ are transmitted from the variable displacement pump 3 over the sensor 4 to the crane control system 10.

Furthermore, the crane control system knows about the set control flow rate $I_{Ventil}$ at the directional seated valve 5. In addition, the excursion of the operating lever (MS) 6 is made accessible to the crane control system 10 by means of the bus system or radio transmission.

The crane control system receives the volumetric flow rate requested by the operator ($Q_{Fahrer}$) as the setpoint input. The operator determines the volumetric flow rate $Q_{Fahrer}$ by actuating the operating lever 6 and, as a result, by adjusting the valve flow rate ($I_{Ventil}$). The goal of the control system is to compute for the requested volumetric flow rate $Q_{Fahrer}$ a suitable motor speed $n_{MOT_Max}$, at which the volumetric flow rate of the crane pump $Q_{PU}$ corresponds to the requested setpoint volumetric flow rate $Q_{Fahrer}$. The motor speed is computed and adjusted in consideration of the working speed and the output power.

In the event that the drive motor 1 is running in idle mode, the displacement volume of the hydraulic pump(s) 3 is changed with the swashplate angle of the hydraulic pump(s) 3. If the operator demands a higher quantity of consumption than the pump 3 can deliver at a maximum displacement volume in the idle operating mode, then at this point the motor speed $n_{MOT}$ has to be increased, in order to deliver the quantity demanded.

The volumetric flow rate $Q_{Fahrer}$ depends, according to equation 8, on the motor speed, the maximum displacement volume $V_{G,PU,MAX}$ of the pump 3 and the pump/motor transmission ratio. In this respect it pays to observe that the computation is always performed with the maximum displacement volume of the hydraulic pump(s) 3 $V_{G,PU,MAX}$= constant.

Working Speed:

$$Q_{Fahrer}\left[\frac{1}{\min}\right] = \frac{n_{MOT,SPEED}\left[\frac{U}{\min}\right] \cdot V_{G,PU,MAX}\left[\frac{1}{U}\right] \cdot u_{PU,MOT}}{1000 \cdot 1000} \Rightarrow Q_{Fahrer} \sim n_{MOT,SPEED} \quad \text{Equation 8}$$

Assuming that not only the displacement volume but also the transmission ratio is constant, it follows from the equation 8 that the requested volumetric rate of flow changes in proportion to the speed. If this equation is transposed for the motor speed, then the following equation is obtained:

$$n_{MOT,SPEED}\left[\frac{U}{\min}\right] = \frac{Q_{Fahrer}\left[\frac{1}{\min}\right] \cdot 1000 \cdot 1000}{V_{G,PU,MAX}\left[\frac{1}{U}\right] \cdot u_{PU,MOT}} \Rightarrow n_{MOT,SPEED} \sim Q_{Fahrer} \quad \text{Equation 9}$$

The requested volumetric flow rate $Q_{Fahrer}$ is converted into a motor speed $n_{MOT,\ SPEED}$ by means of equation 9.

Output Power:

In order to consider the output power, which the crane operator requests with the volumetric flow rate $Q_{Fahrer}$, the current motor output power $P_{MOT}$ has to be computed.

$$P_{MOT}[\text{kW}] = \frac{Q_{Fahrer}\left[\frac{1}{\min}\right] \cdot p_{PU}[\text{bar}]}{600} \quad \text{Equation 10}$$

The component $p_{PU}$ represents the pump pressure of the pump 3. A motor output power $P_{MOT}$ can also be computed by means of the following formula.

$$P_{MOT}[\text{kW}] = \frac{M_{Mot}[\text{Nm}] \cdot \eta_{Mot,Power}\left[\frac{1}{\min}\right]}{9549} \quad \text{Equation 11}$$

where $M_{MOT}$ stands for the motor torque. If the equations 10 and 11 are set equal to each other $$\frac{Q_{Fahrer}\left[\frac{1}{\min}\right] \cdot p_{PU}[\text{bar}]}{600} = \frac{M_{Mot}[\text{Nm}] \cdot \eta_{Mot,Power}\left[\frac{1}{\min}\right]}{9549}$$

and transposed for the speed $n_{MOT,\ POWER}$, then the following equation is obtained:

$$\eta_{Mot,Power}\left[\frac{1}{\min}\right] = \frac{Q_{Fahrer}\left[\frac{1}{\min}\right] \cdot p_{PU}[\text{bar}] \cdot 9549}{600 \cdot M_{Mot}[\text{Nm}]} \Rightarrow \eta_{MOT,POWER} \sim Q_{Fahrer} \quad \text{Equation 12}$$

It is clear from the two equations 9 and 12 that the volumetric flow rate $Q_{Fahrer}$ is always a function of the speed $n_{MOT}$ of the drive motor 1. Of the two computed motor speeds ($n_{MOT,\ SPEED}$, $n_{MOT,\ POWER}$), the greater speed is sent in each case to the motor control unit. The motor torque $M_{MOT}$, which is needed for the motor speed according to equation 12, can be either the motor torque, which is currently being outputted by the motor control unit, or a motor torque, which is determined from a motor characteristic map.

Even with this control algorithm it is possible to distinguish between the two known cases. Equations 9 and 12 show very clearly that the motor speeds $n_{MOT,\ SPEED}$, $n_{MOT,\ POWER}$ increase in proportion to the volumetric flow rate. The crane control system determines continuously these motor speeds from a volumetric flow rate $Q_{Fahrer}$ requested by the operator. The greater of the two motor speeds is determined in block 40 and is sent to the drive motor 1 as the setpoint speed $n_{MOT,\ MAX}$. After the setpoint speed $n_{MOT,\ MAX}$ has been reached, the crane pump continues to pump until the volumetric rate of flow corresponds to that of $Q_{Fahrer}$.

Case 1: hydraulic motor 7 under low load

Given are the following variables:

$Q_{Fahrer}$=200 l/min $U_{PU,\ MOT}$=1,000

$n_{MOT,\ SPEED}$=847 rpm (according to equation 9)

$n_{MOT,\ POWER}$=477 rpm (according to equation 12)

$p_{PU}$=60 bar $V_{G,PU,MAX}$=236 ccm $P_{MOT}$=40 kW (according to equation 10)

$M_{MOT}$=400 Nm

The crane control system 10 determines the motor speeds $n_{MOT,\ SPEED}$ and $n_{MOT,\ POWER}$ from the volumetric flow rate $Q_{Fahrer}$ requested by the operator. In the case of the hydraulic motor 7 with no load, the measured pump pressure $p_{PU}$ is very low. The determined motor speed $n_{MOT,\ POWER}$ will be very much lower than the motor speed $n_{MOT,\ SPEED}$. This means that the motor speed $n_{MOT,\ SPEED}$ is sent to the crane motor as the setpoint speed.

Case 2: hydraulic motor (7) under high load

Given:

Given are the following variables:

$Q_{Fahrer}$=200 l/min $U_{PU,\ MOT}$=1,000

$n_{MOT,\ SPEED}$=847 rpm (according to equation 9)

$n_{MOT,\ POWER}$=1,326 rpm (according to equation 12)

$p_{PU}$=250 bar $V_{G,PU,MAX}$=236 ccm $P_{MOT}$=80 kW (according to equation 10)

$M_{MOT}$=600 Nm

The crane control system 10 determines the motor speeds $n_{MOT,\ SPEED}$ and $n_{MOT,\ POWER}$ from the volumetric flow rate $Q_{Fahrer}$ requested by the operator. In the case of the hydraulic motor 7 under a load, the measured pump pressure $p_{PU}$ is very high. The determined motor speed $n_{MOT,\ POWER}$ will be very much higher than the motor speed $n_{MOT,\ SPEED}$. This means that the motor speed $n_{MOT,\ POWER}$ is sent to the crane motor as the setpoint speed.

According to FIG. 6, the maximum motor speed $n_{MOT,\ MAX}$ is transmitted to the ramp function generator (HG) 50 that is located downstream. In order to make it easier to understand, the input signal at the ramp function generator 50 is labelled $n_{MOT,\ MAX,\ HG}$, whereas the output signal is labelled $n_{MOT,\ MAX,\ PT1}$. The ramp function generator 50 from FIG. 6 is used to stabilize the motor speed and, as a result, also the mobile crane itself, thus enabling a handling performance that is as uniform as possible.

Figure 7:
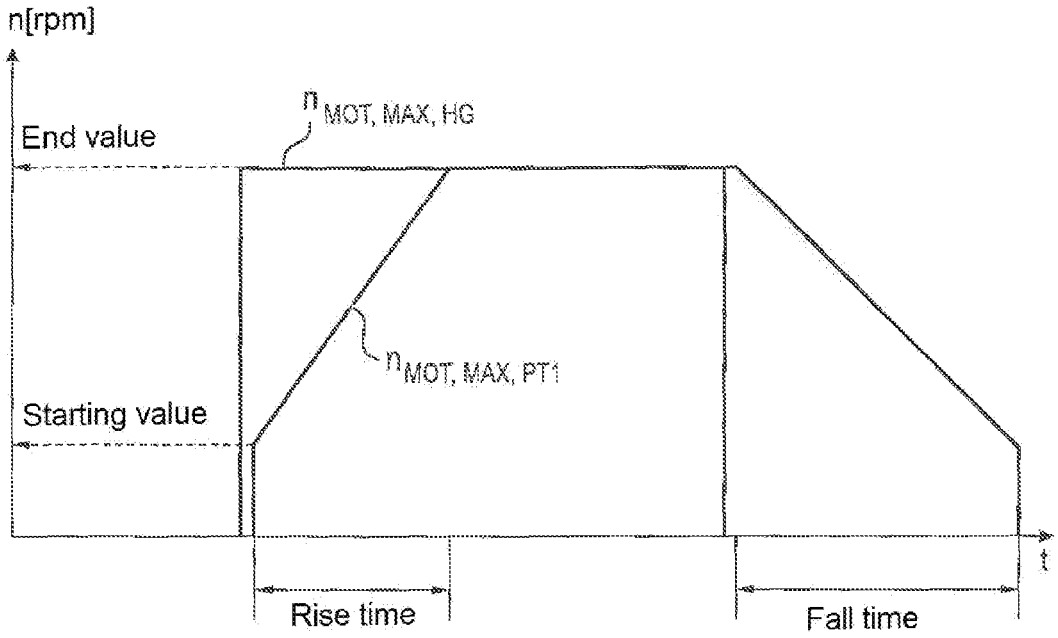
FIG. 7 is a diagram for elucidating the step response of the ramp function generator that is used in the function diagram from FIG. 7.

FIG. 7 shows the step response of the ramp function generator 50. The rise time and the fall time are used to control the speed, at which the output signal of the ramp function generator follows the input signal. These times as well as the starting value and the final value can be adjusted dynamically.

Then the output signal of the ramp function generator 50 is transmitted to the PT1 element 60. A linear time-invariant transmission element in control technology is referred to as a PT1 element; and this linear time-invariant transmission element exhibits a proportional transmission characteristic with a first order lag.

Figure 8:
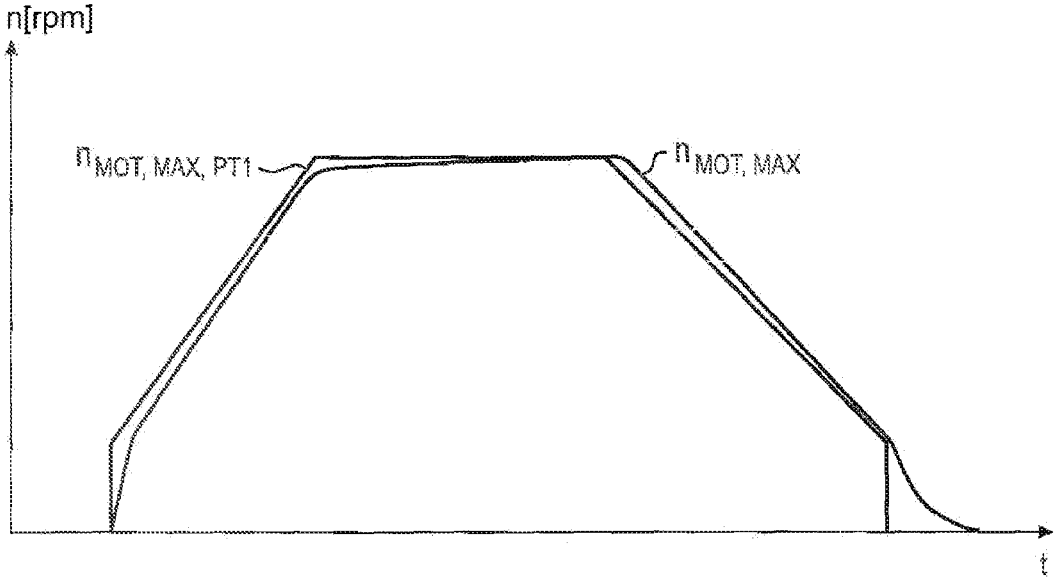
FIG. 8 is a diagram for elucidating the transmission function of the PT1 element that is used in the function diagram from FIG. 7.

The PT1 element receives the output signal $n_{MOT,\ MAX,\ PT1}$ of the ramp function generator 50 as an input variable and generates, according to the transmission function shown in FIG. 8, the output speed $n_{MOT,\ MAX}$, which is transmitted in the final end to the motor control unit of the motor 1 as the setpoint speed.

Figure 9:
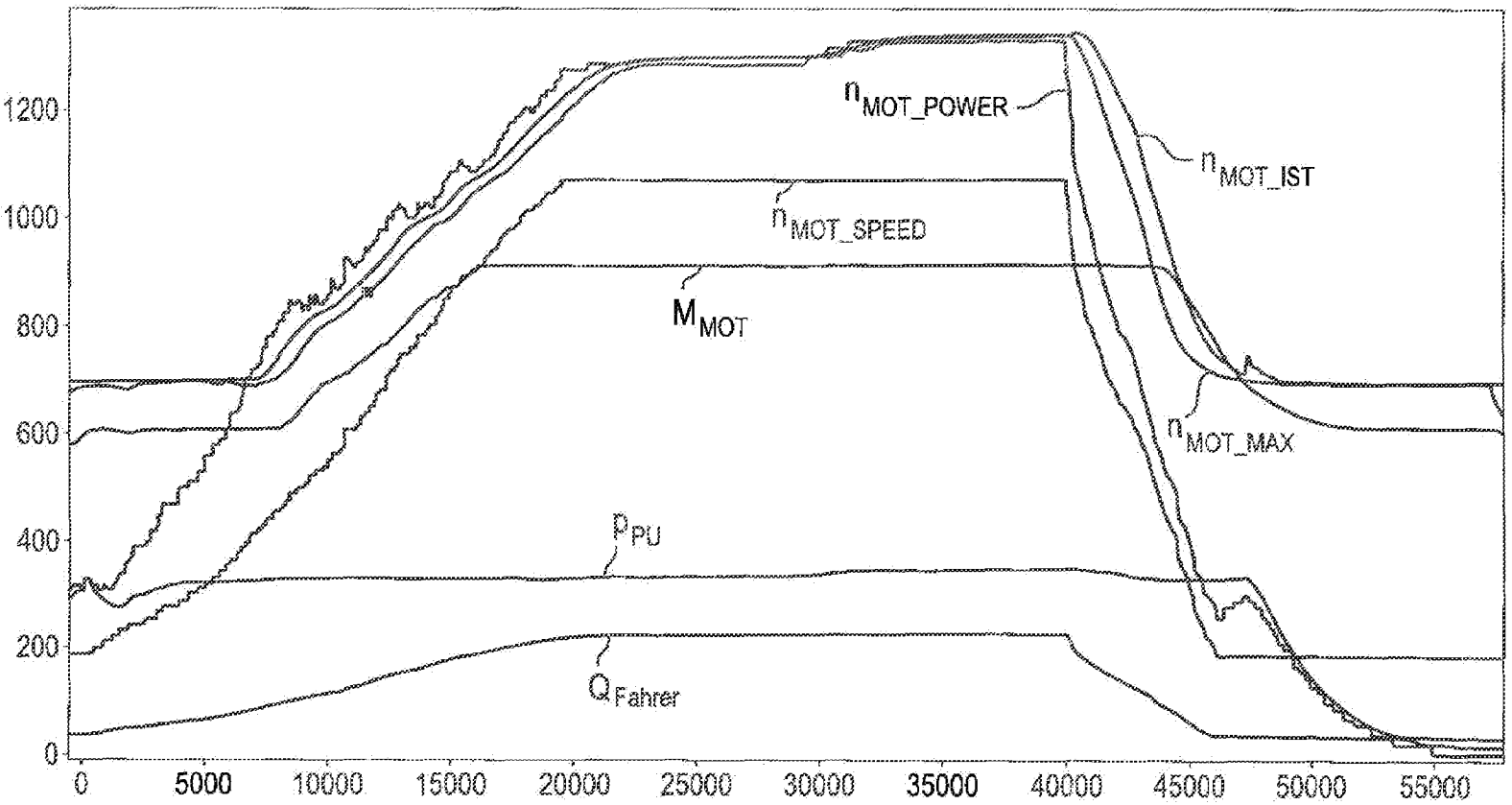
FIG. 9 is a measurement diagram for the application scenario of the control algorithm from FIG. 7.

Finally, FIG. 9 shows a measurement diagram that elucidates the characteristic of the relevant variables for the crane control system as a function of time in the described second case with a hydraulic motor 7 under a high load, i.e. with a comparatively high pump pressure $p_{PU}$. The demanded volumetric flow rate $Q_{Fahrer}$ increases at the start and then reaches a level of 200 l/min at the time t=20 seconds. Then the actual motor speed is based on the speed $n_{MOT,\ SPEED}$ in a time window t=0 and t=6 seconds. After the time t=6 seconds, the computed motor speed $n_{MOT,\ POWER}$ exceeds the motor speed $n_{MOT,\ SPEED}$, so that the actual motor speed $n_{MOT,\ IST}$ follows the motor speed $n_{MOT,\ POWER}$. At the time t=40 seconds, the demand for the volumetric rate of flow is reset, and the speed is adjusted downwards.

The invention claimed is:

1. A method for synchronizing a speed of a hydraulic crane drive having at least one hydraulic consumer, which is fed with a variable volumetric rate of flow by way of at least one hydraulic variable displacement pump, comprising:

driving the at least one hydraulic variable displacement pump by way of a drive unit of the crane, and controlling a speed of the drive unit and a swashplate angle of said at least one hydraulic variable displacement pump, with at least one of an open loop control and a closed loop control, as a function of a demanded volumetric flow rate for at least one consumer, on the basis of one additional parameter, or both as a function of the demanded volumetric flow rate for the at least one consumer and on the basis of the one additional parameter, by way of a crane control system, wherein the crane control system adjusts, individually and load-dependent, at least one of an acceleration ramp and a deceleration ramp of the speed of the drive unit.

2. The method of claim 1, further comprising actuating at least one proportionally controllable directional seated valve.

3. The method of claim 1, wherein an open loop control of the swashplate angle and an open loop control of the speed of the drive unit take place.

4. The method of claim 1, wherein the demanded volumetric flow rate is set by way of at least one operating lever.

5. The method of claim 4, wherein a current position of the at least one operating lever is signaled selectively by at least one of a bus connection and radio link to the crane control system.

6. The method of claim 1, wherein a set speed of the drive unit is determined by way of at least one characteristic performance map of the drive unit.

7. The method of claim 1, wherein the additional parameter is a value that characterizes at least one of a height level above normal zero of the crane, a charging process of an energy accumulator, efficiency of at least some of the consumers, the ambient temperature of the crane, and a set speed input of a crane operator.

8. The method of claim 1, further comprising overriding speed synchronization by way of a gas pedal actuation or other user input.

9. The method of claim 1, wherein the speed of the drive unit is increased until the volumetric rate of flow, which is determined from the instantaneous speed, matches or converges toward the demanded volumetric flow rate.

10. The method of claim 1, wherein a volumetric flow rate that is determined from at least one of instantaneous motor output power and instantaneous pump pressure is adjusted to the demanded volumetric flow rate by controlling the speed of the drive unit.

11. The method of claim 1, wherein said at least one hydraulic consumer is one of a plurality of hydraulic consumers, and the crane control system combines individual volumetric flow rate demands into one total demand, and wherein a maximum delivery volume is divided among the consumers in proportion to the respective demand, in the event that the total demand exceeds a maximum delivery quantity.

12. The method of claim 1, wherein a mechanical drive train is uncoupled when the crane control system determines an idle operating mode is present.

13. A hydraulic crane drive with a crane control system for carrying out a method as claimed in claim 1.

14. A mobile crane comprising a hydraulic crane drive as claimed in claim 13.

15. A method for synchronizing a speed of a hydraulic crane drive having at least one hydraulic consumer, which is fed with a variable volumetric rate of flow by way of at least one hydraulic variable displacement pump, comprising:

driving the at least one hydraulic variable displacement pump by way of a drive unit of the crane, and controlling a speed of the drive unit and a swashplate angle of said at least one hydraulic variable displacement pump, with at least one of an open loop control and a closed loop control, as a function of a demanded volumetric flow rate for at least one consumer, on the basis of one additional parameter, or both as a function of the demanded volumetric flow rate for the at least one consumer and on the basis of the one additional parameter, by way of a crane control system, wherein a change in the demanded volumetric rate of flow is delayed, accelerated, or delayed and accelerated by way of a ramp function generator.

16. The method of claim 15, wherein the speed of the drive unit is computed from the demanded volumetric flow rate.

* * * * *